US005950929A

United States Patent [19]

Collier et al.

[11] Patent Number: 5,950,929

[45] Date of Patent: Sep. 14, 1999

[54] BURNER CONSTRUCTION

[75] Inventors: John P. Collier, Franklin Lakes; Edward K. Chang, Gillette; Weiji Huang, Bound Brook; John Connors, Beachwood, all of N.J.

[73] Assignee: The BOC Group, Inc., New Providence, N.J.

[21] Appl. No.: 08/866,852

[22] Filed: May 30, 1997

Related U.S. Application Data

[60] Provisional application No. 60/027,872, Oct. 25, 1996.

[51] Int. Cl.[6] ..... B05D 15/00

[52] U.S. Cl. ..... 239/397.5; 239/DIG. 19

[58] Field of Search ..... 239/DIG. 19, 397.5

[56] References Cited

U.S. PATENT DOCUMENTS 2,183,596 12/1939 Trinks ..... 239/397.5
3,874,599 4/1975 Rodger ..... 239/557

FOREIGN PATENT DOCUMENTS 739028 10/1955 United Kingdom ..... 239/397.5

*Primary Examiner*—Carroll Dority
*Attorney, Agent, or Firm*—David M. Rosenblum; Salvatore P. Pace

[57] ABSTRACT

A burner construction having a body portion fabricated from a base material and coating material covering the base material. The base material is formed of copper or copper alloy having a conductivity of no less than about 100 watts/meter/° C. Alternatively the base material can be silver. The coating material comprises nickel or nickel based alloy which can be an autocatalytic plating.

9 Claims, 1 Drawing Sheet

FIG.
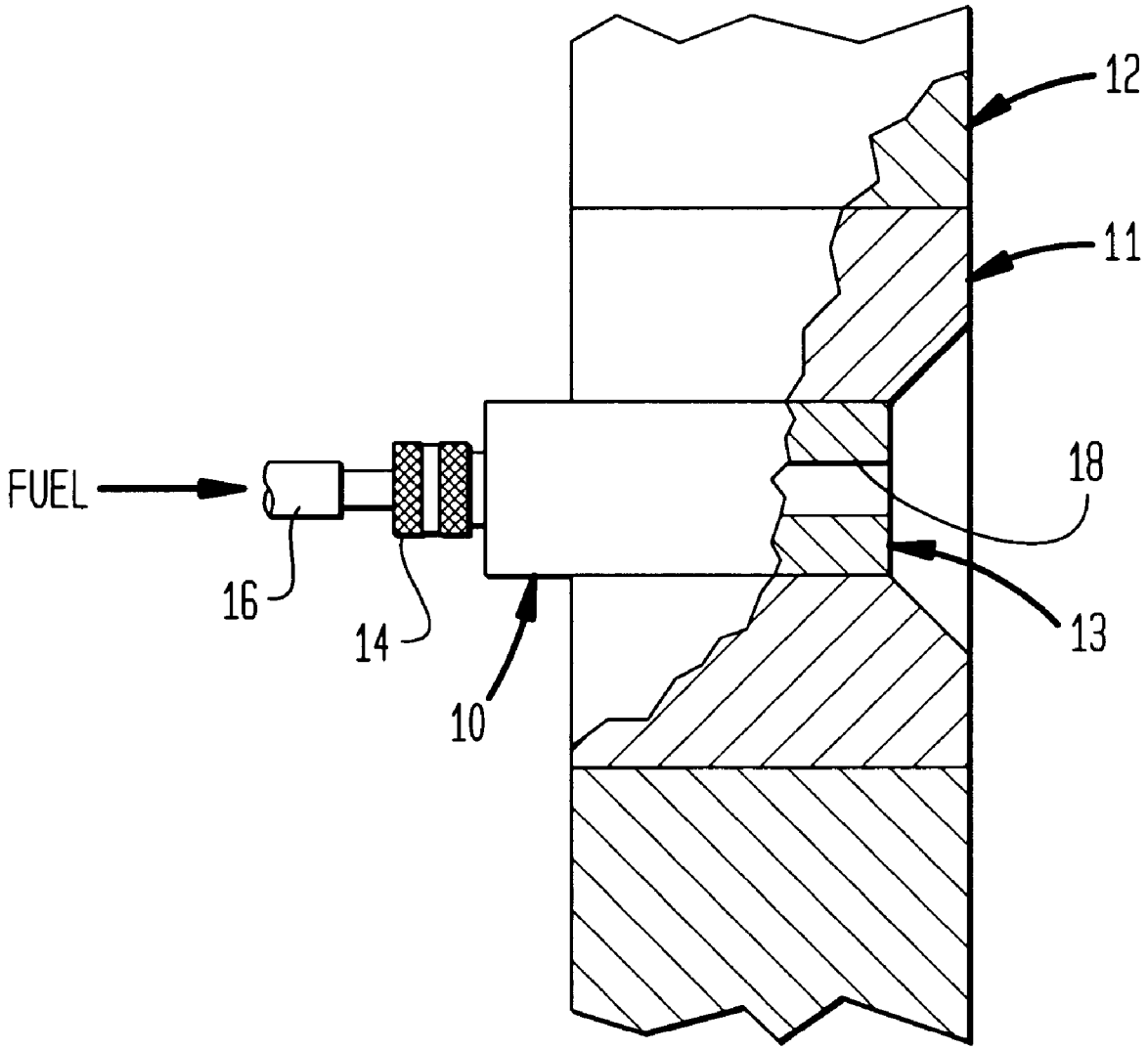

BURNER CONSTRUCTION

RELATED APPLICATIONS

This Application claims priority from Provisional Patent Application No. 60/027,872 filed Oct. 25, 1996.

BACKGROUND OF THE INVENTION

The present invention relates to a burner construction in which a body portion of a burner is fabricated from a base metal comprising copper or copper alloy. More particularly, the present invention relates to such a burner construction in which a protective coating, comprising nickel or a nickel based alloy, is applied to the base metal.

In many industrial activities burners are used to heat materials to their melting point in order to process such materials as melts. For instance, Burners find wide application in the glass, aluminum and steel making industries. Typically, industrial burners are fabricated from stainless steel and are designed to burn a liquid or gaseous fuel in air, oxygen enriched air or purified oxygen. The problem with using stainless steel, is that at high temperatures, the body of the burner from which the flame emanates, can oxidize and melt. This problem is particularly acute when combustion temperatures are increased by provision of oxygen or oxygen enrichment.

In burners fabricated from stainless steel, oxidation is most severe at extreme temperatures that approach the melting point of the steel. Although the entire surface of the burner that is exposed to the furnace atmosphere can be oxidized, oxidation is particularly pronounced at the tip of the burner. The reason for this is that a hot spot develops at the tip of the burner due to the low thermal conductivity of stainless steel. The hot spot can also cause melting. In order to eliminate the potential for melting, higher conductivity materials have been used for burners such as copper and copper alloys. Copper or alloys of copper as a burner material can also be problematical in certain applications involving furnace environments containing sulfur. In such environments copper will not only oxidize but experience sulfidation.

As will be discussed, the present invention provides a burner construction that is resistant to oxidation and sulfidation.

SUMMARY OF THE INVENTION

The present invention provides a burner construction comprising a body portion fabricated from a base material and a coating material covering the base material on at least those regions of the body portion that are subjected to extreme temperatures. As used herein and in the claims the term "extreme temperature" means a temperature of greater than about 50% of the melting point temperature of the base material used in fabricating the body of the burner. Practically speaking for a burner fabricated from copper, an extreme temperature would be about 400° C. In this regard, the base metal can comprise silver, copper or a copper alloy having a thermal conductivity of no less than about 100 watts/meter/° C. The coating material can comprise nickel or a nickel based alloy.

The burner construction of the present invention thus has the advantage of using a highly thermally conductive copper alloy which at the same time is resistant to oxidation and high temperature corrosion. The high thermal conductivity of copper and copper alloys allows heat to be conducted away from the hot face of the burner and to greatly reduce the overall temperature of the burner. The lower overall temperature of the burner allows the use of a coating which acts as a protective barrier against corrosion. A further advantage of the copper alloy is that a burner construction of the present invention can be a cost effective casting or brazing instead of labor intensive, machined and welded stainless steel construction.

BRIEF DESCRIPTION OF THE DRAWINGS

While the specification concludes with claims distinctly pointing out the subject matter that Applicant regards as his invention, it is believed the invention will be better understood when taken in connection with the sole FIGURE which is a fragmentary view of a burner set within a burner block with portions broken away.

DETAILED DESCRIPTION

With reference to the FIGURE, a burner 10 is set within a burner block 11 which is in turn set into a wall 12 of a furnace. Burner 10 has a body portion 13 set within burner block 13. A quick disconnect fitting 14 is provided to attach a fuel line 16 to body portion 13 of burner 10. Fuel is expelled from body portion 13 through an internal passageway 18 thereof. It is to be noted that as used herein and in the claims, the term "body portion" of a burner means the burner exclusive of all fuel and oxidant line fittings, controls, and mounting brackets.

Although for purposes of simplicity of description, burner 10 is an air-fuel burner, the present invention would have particular application to oxy-fuel burners and air-oxy-fuel burners in which the oxidant was oxygen or oxygen enriched air, respectively, because such burners operate at particularly high temperatures as compared with air-fuel burners. Additionally, the present invention has particular application to burners that do not employ water cooling and thus, have a high potential for developing hot spots.

Body portion 13 is fabricated from the base material that can be copper or another copper alloy such as copper beryllium, copper silver or other copper containing alloys. Body portion 13 could be fabricated from silver.

In addition to the heat conduction advantages of using copper, a further advantage is that copper and copper alloys can be cast or brazed. In conventional burner construction, stainless steel is welded and machined to close tolerances. In a burner in accordance with the present invention, body portion 13 could be cast in a mold. Such construction reduces the cost of the finished burner.

In order to prevent corrosion, body portion 13 is in its entirety coated with the coating material that comprises a nickel or nickel based alloy (such as nickel phosphorous or nickel tungsten). For instance all of the external surface of body portion 13 as well as the surface defining internal passageway 18 would be coated by an autocatalytic plating of a nickel alloy. Similarly, in case of an oxy-fuel burner, surfaces defining internal oxygen passageways would also be coated. As could be appreciated, the present invention could be advantageously practiced by coating only that portion of body portion 13 of burner 10 that is subject to extreme temperatures. As can be appreciated, the temperature of body portion 13 is greatest at its tip since the flame emanates from this part of body portion 13. The temperature then decreases along the length of the burner. Thus, in a particular application of a burner in accordance with the present invention, a portion of body portion 13 including the tip of the burner could be above the extreme temperature and a remaining portion could be below the extreme temperature. In such case the portion above the extreme temperature could be coated and the remaining portion left uncoated. In addition, any coating applied to body portion 13 could be covered with gold plating or other noble metal for further protection. Although untested, it is thought by the inventors herein that a ceramic layer could be provided in place of the gold plating or other noble metal.

The coating material is preferably applied to produce a thickness in an range of between about 0.0150 mm and about 0.127 mm. A more preferred range is between about 0.0150 mm and about 0.08 mm. A still more preferable range is between about 0.020 mm. and about 0.050 mm. A plating thickness of about 0.020 mm is particularly preferred. In case of an additional layer of gold plating, a plating thickness of about 1 micron is a preferred thickness.

Preferably, after the plating process is completed, the burner is heat treated to further improve its oxidation and scaling resistance. Such heat treatment begins by baking burner 10 at a temperature within a range of between about 150° C. and about 200° C. for about two hours. This is followed by a high temperature heat treatment in an inert gas atmosphere such as nitrogen in a temperature range of between about 500° C. and about 700° C. for no less than about four hours. A heat treatment temperature of about 700° C. is a preferred temperature in the foregoing range.

Although the present invention has been described with reference to a preferred embodiment, as will occur to those skilled in the art, numerous changes additions and omissions may be made without departing from the spirit and scope of the present invention.

We claim:

1. A burner construction comprising:

a body portion fabricated from a base material and a coating material covering said base material on at least those regions of said body portion subjected to extreme temperatures;

said base material comprising silver, copper or a copper alloy having a thermal conductivity of no less than about 100 watts/meter/° C.; and said coating material comprising nickel or a nickel based alloy.

2. The burner construction of claim 1, wherein said coating material comprises an auto-catalytic plating.

3. The burner of construction of claim 2, further comprising gold plating or other noble metal covering said coating material.

4. The burner construction of claim 2, wherein said coating material has a thickness in a range of between about 0.0150 mm and about 0.127 mm.

5. The burner construction of claim 2, wherein said coating material has a thickness in a range of between about 0.0150 mm. and about 0.080 mm.

6. The burner construction of claim 2, wherein said coating material has a thickness in a range of between about 0.020 mm. and about 0.050 mm.

7. The burner construction of claim 2, wherein said coating material has a thickness of about 0.020 mm.

8. The burner construction of claim 1 or claim 2 or claim 7 wherein said base material comprises a casting.

9. The burner construction of claim 2, further comprising gold plating covering said coating material having a thickness of about 1 micron.

* * * * *